US011236941B2

(12) United States Patent
Noureldin et al.

(10) Patent No.: US 11,236,941 B2
(45) **Date of Patent: *Feb. 1, 2022**

(54) PROCESS INTEGRATION FOR NATURAL GAS LIQUID RECOVERY

(71) Applicant: Saudi Arabian Oil Company, Dhahran (SA)

(72) Inventors: Mahmoud Bahy Mahmoud Noureldin, Dhahran (SA); Akram Hamed Mohamed Kamel, Dhahran (SA); Abdulaziz A. AlNajjar, Alhassa (SA)

(73) Assignee: Saudi Arabian Oil Company, Dhahran (SA)

( * ) Notice: Subject to any disclaimer, the term of this patent is extended or adjusted under 35 U.S.C. 154(b) by 105 days.

This patent is subject to a terminal disclaimer.

(21) Appl. No.: 16/135,726

(22) Filed: Sep. 19, 2018

(65) Prior Publication Data

US 2019/0186818 A1 Jun. 20, 2019

Related U.S. Application Data

(60) Provisional application No. 62/599,509, filed on Dec. 15, 2017.

(51) Int. Cl.
*F25J 1/02* (2006.01)
*F25J 3/02* (2006.01)
(Continued)

(52) U.S. Cl.
CPC ..... *F25J 3/0209* (2013.01); *F25J 1/0022* (2013.01); *F25J 1/0037* (2013.01); *F25J 1/0092* (2013.01);
(Continued)

(58) Field of Classification Search
CPC ..... F25J 1/0022; F25J 1/0191; F25J 1/0095; F25J 1/0092; F25J 3/0209; F25J 3/0238;
(Continued)

(56) References Cited

U.S. PATENT DOCUMENTS 3,592,015 A 7/1971 Streich et al.
3,593,535 A * 7/1971 Gaumer, Jr. ..... F25J 1/0291 62/612
(Continued)

FOREIGN PATENT DOCUMENTS

CN 1326913 12/2001
CN 102538390 8/2014
(Continued)

OTHER PUBLICATIONS

International Search Report and Written Opinion issued in International Application No. PCT/US2018/065198 dated Jul. 18, 2019, 22 pages.
(Continued)

*Primary Examiner* — Brian M King
(74) *Attorney, Agent, or Firm* — Fish & Richardson P.C.

(57) ABSTRACT

This specification relates to operating industrial facilities, for example, crude oil refining facilities or other industrial facilities that include operating plants that process natural gas or recover natural gas liquids.

23 Claims, 3 Drawing Sheets

(51) Int. Cl.

| | |
|---|---|
| ***F25J 5/00*** | (2006.01) |
| ***F25J 1/00*** | (2006.01) |
| ***F25J 3/04*** | (2006.01) |
| ***F28D 9/00*** | (2006.01) |

(52) U.S. Cl.

CPC ..... *F25J 1/0238* (2013.01); *F25J 1/0262* (2013.01); *F25J 1/0291* (2013.01); *F25J 3/0233* (2013.01); *F25J 3/0238* (2013.01); *F25J 3/0295* (2013.01); *F25J 3/04787* (2013.01); *F25J 3/04872* (2013.01); *F25J 5/002* (2013.01); *F25J 5/005* (2013.01); *F28D 9/0006* (2013.01); *F25J 3/0242* (2013.01); *F25J 3/0247* (2013.01); *F25J 2200/02* (2013.01); *F25J 2200/70* (2013.01); *F25J 2200/74* (2013.01); *F25J 2205/04* (2013.01); *F25J 2205/40* (2013.01); *F25J 2205/50* (2013.01); *F25J 2205/60* (2013.01); *F25J 2210/06* (2013.01); *F25J 2210/12* (2013.01); *F25J 2210/60* (2013.01); *F25J 2215/04* (2013.01); *F25J 2215/60* (2013.01); *F25J 2215/62* (2013.01); *F25J 2215/64* (2013.01); *F25J 2215/66* (2013.01); *F25J 2220/68* (2013.01); *F25J 2230/30* (2013.01); *F25J 2230/32* (2013.01); *F25J 2230/60* (2013.01); *F25J 2240/02* (2013.01); *F25J 2240/60* (2013.01); *F25J 2245/02* (2013.01); *F25J 2260/60* (2013.01); *F25J 2270/12* (2013.01); *F25J 2270/18* (2013.01); *F25J 2270/60* (2013.01); *F25J 2270/66* (2013.01); *F25J 2270/902* (2013.01); *F25J 2290/40* (2013.01); *F25J 2290/80* (2013.01)

(58) Field of Classification Search

CPC .. F25J 2245/02; F25J 2290/40; F25J 2210/12; F25J 2215/62; F25J 2230/30; F25J 2205/50

See application file for complete search history.

(56) References Cited

U.S. PATENT DOCUMENTS

| | | | | |
|---|---|---|---|---|
| 3,808,826 | A | 5/1974 | Harper et al. | |
| 4,022,597 | A | 5/1977 | Bacon | |
| 4,325,231 | A | 4/1982 | Noureldin et al. | |
| 4,541,852 | A * | 9/1985 | Newton | F25J 1/0022 62/613 |
| 4,689,063 | A | 8/1987 | Paradowski et al. | |
| 4,738,699 | A | 4/1988 | Apffel | |
| 4,976,849 | A | 12/1990 | Soldati | |
| 5,114,450 | A | 5/1992 | Paradowski et al. | |
| 5,329,774 | A | 7/1994 | Tanguay et al. | |
| 5,813,250 | A | 9/1998 | Ueno et al. | |
| 5,943,881 | A | 8/1999 | Grenier | |
| 6,253,574 | B1 | 7/2001 | Stockmann et al. | |
| 6,662,589 | B1 * | 12/2003 | Roberts | F25J 1/005 62/425 |
| 7,257,966 | B2 | 8/2007 | Lee et al. | |
| 2004/0069015 | A1 | 4/2004 | Paradowski et al. | |
| 2004/0206112 | A1 | 10/2004 | Mak | |
| 2004/0237581 | A1 * | 12/2004 | Paradowski | F25J 3/0219 62/620 |
| 2006/0004242 | A1 | 1/2006 | Verma et al. | |
| 2006/0162378 | A1 | 7/2006 | Roberts et al. | |
| 2008/0173043 | A1 | 7/2008 | Kaart | |
| 2008/0190136 | A1 * | 8/2008 | Pitman | F25J 3/0209 62/620 |
| 2008/0264081 | A1 * | 10/2008 | Crowell | F02M 26/47 62/132 |
| 2009/0100862 | A1 * | 4/2009 | Wilkinson | F25J 3/0238 62/620 |
| 2013/0269386 | A1 * | 10/2013 | Brostow | F25J 1/0055 62/613 |
| 2014/0290307 | A1 | 10/2014 | Gahier et al. | |
| 2014/0352353 | A1 | 12/2014 | Wissolik | |
| 2015/0073194 | A1 * | 3/2015 | Hudson | F25J 3/0238 585/802 |
| 2015/0184930 | A1 | 7/2015 | Bonnissel et al. | |
| 2015/0260451 | A1 | 9/2015 | Haberberger et al. | |
| 2016/0298898 | A1 | 10/2016 | Ducote et al. | |
| 2017/0010043 | A1 * | 1/2017 | Ducote, Jr. | F25J 1/0296 |
| 2017/0058711 | A1 | 3/2017 | Noureldin et al. | |
| 2017/0122659 | A1 | 5/2017 | Gnanendran et al. | |
| 2017/0336136 | A1 | 11/2017 | Brostow et al. | |
| 2017/0336137 | A1 | 11/2017 | Mak et al. | |
| 2018/0045460 | A1 * | 2/2018 | Zubrin | F25J 3/0209 |
| 2018/0347899 | A1 | 12/2018 | Cuellar et al. | |
| 2019/0186820 | A1 | 6/2019 | Noureldin et al. | |
| 2019/0186821 | A1 | 6/2019 | Noureldin et al. | |
| 2019/0186822 | A1 | 6/2019 | Noureldin et al. | |
| 2019/0186824 | A1 | 6/2019 | Noureldin et al. | |
| 2019/0186825 | A1 | 6/2019 | Noureldin et al. | |
| 2019/0186826 | A1 | 6/2019 | Noureldin et al. | |
| 2019/0271503 | A1 | 9/2019 | Terrien et al. | |

FOREIGN PATENT DOCUMENTS

| | | |
|---|---|---|
| CN | 103363778 | 7/2015 |
| CN | 105486034 | 4/2016 |
| GB | 2146751 | 4/1985 |

OTHER PUBLICATIONS

International Search Report and Written Opinion issued in International Application No. PCT/US2018/065216 dated Jul. 22, 2019, 27 pages.

International Search Report and Written Opinion issued in International Application No. PCT/US2018/065221 dated Jul. 23, 2019, 28 pages.

International Search Report and Written Opinion issued in International Application No. PCT/US2018/065227 dated Jul. 22, 2019, 30 pages.

Ringer, "Mehrstrom-Waermeaustauscherals Geloetete Aluminium-Plattenapparte-Stand Des Wissens," Chemi Ingenieur Technik, Wiley, Vch, Verlag, vol. 63, No. 1, Jan. 1, 1991, english abstract provided, 6 pages.

GCC Examination Report in GCC Appln. No. GC 2018-36651, dated Apr. 15, 2020, 4 pages.

GCC Examination Report in GCC Appln. No. GC 2018-36652, dated Apr. 16, 2020, 3 pages.

GCC Examination Report in GCC Appln. No. GC 2018-36654, dated Apr. 17, 2020, 3 pages.

GCC Examination Report in GCC Appln. No. GC 2018-36656, dated Apr. 18, 2020, 4 pages.

Haslego and Polley, "Designing Plate-and-Frame Heat Exchangers," Heat Exchangers, Compact Heat Exchangers—Part 1: Sep. 2002, 6 pages.

Linde, "Aluminum Plate-Fin Heat Exchanges," the Linde Group, available on or before Nov. 2017, 12 pages.

Lunsford, "Advantages of Brazed Heat Exchangers in the Gas Processing Industry," proceedings of the Seventy-Fifth GPA Annual Convention: Gas Processors Association, 1996, published Dec. 31, 1997, 9 pages.

Mehrpooya et al., "Introducing a novel integrated NGL recovery process configuration with a self-refrigeration system (open-closed cycle) with minimum energy requirement," Chemical Engineering and Processing vol. 49, issue 4, Apr. 2010, 13 pages.

Montanez-Morantes et al., "Available online Design and simulation of multistream plate-fin head exchangers—Single-Phase streams," Applied Thermal Engineering, vol. 92, Jan. 5, 2016, 15 pages.

Wang and Li, "Layer pattern thermal design and optimization for multistream plate-fin heat exchangers—a review," Renewable and Sustainable Energy Reviews, vol. 53, Jan. 2016, 15 pages.

(56) References Cited

OTHER PUBLICATIONS

International Search Report and Written Opinion issued in International Application No. PCT/US2018/065220 dated Apr. 5, 2019, 17 pages.
Invitation to Pay Additional Fees and, Where Applicable, Protest Fee, issued in International Application No. PCT/US2018/065197 dated Apr. 1, 2019, 23 pages.
Invitation to Pay Additional Fees and, Where Applicable, Protest Fee, issued in International Application No. PCT/US2018/065199 dated Apr. 3, 2019, 24 pages.
International Search Report and Written Opinion issued in International Application No. PCT/US2018/065229 dated Apr. 17, 2019, 18 pages.
Invitation to Pay Additional Fees and, Where Applicable, Protest Fees, issued in International Application No. PCT/US2018/065216 dated Apr. 16, 2019, 20 pages.
Invitation to Pay Additional Fees and, Where Applicable, Protest Fee, issued in International Application No. PCT/US2018/065221 dated Apr. 2, 2019, 8 pages.
Invitation to Pay Additional Fees and, Where Applicable, Protest Fee, issued in International Application No. PCT/US2018/065227 dated Apr. 3, 2019, 8 pages.
Invitation to Pay Additional Fees and, Where Applicable, Protest Fee, issued in International Application No. PCT/US2018/065209 dated Apr. 4, 2019, 7 pages.
International Search Report and Written Opinion issued in International Application No. PCT/US2018/065349 dated Mar. 22, 2019, 18 pages.
International Search Report and Written Opinion issued in International Application No. PCT/US2018/065345 dated Mar. 20, 2019, 18 pages.
International Search Report and Written Opinion issued in International Application No. PCT/US2018/065353 dated Mar. 22, 2019, 20 pages.
Invitation to Pay Additional Fees and, Where Applicable, Protest Fee, issued in International Application No. PCT/US2018/065354 dated Mar. 28, 2019, 18 pages.
Invitation to Pay Additional Fees and, Where Applicable, Protest Fees, issued in International Application No. PCT/US2018/065177 dated Mar. 29, 2019, 22 pages.
Invitation to Pay Additional Fees and, Where Applicable, Protest Fees, issued in International Application No. PCT/US2018/065198 dated May 2, 2019.
International Search Report and Written Opinion issued in International Application No. PCT/US2018/065354 dated May 22, 2019.
International Search Report and Written Opinion issued in International Application No. PCT/US2018/065177 dated May 22, 2019, 27 pages.
GCC Examination Report in GCC Appln. No. GC 2018-36650, dated Feb. 17, 2020, 4 pages.
GCC Examination Report in GCC Appln. No. GC 2018-36653, dated Feb. 17, 2020, 5 pages.
GCC Examination Report in GCC Appln. No. GC 2018-36655, dated Feb. 17, 2020, 4 pages.
GCC Examination Report in GCC Appln. No. GC 2018-36643, dated Feb. 22, 2020, 6 pages.
GCC Examination Report in GCC Appln. No. GC 2018-36648, dated Feb. 24, 2020, 5 pages.
GCC Examination Report in GCC Appln. No. GC 2018-36643, dated Aug. 28, 2020, 7 pages.
GCC Examination Report in GCC Appln. No. GC 2018-36641, dated May 16, 2020, 5 pages.
International Search Report and Written Opinion in International Appln. No. PCT/US2018/065197, dated Jul. 23, 2019, 34 pages.
International Search Report and Written Opinion in International Appln. No. PCT/US2018/065209, dated Jul. 22, 2019, 32 pages.
International Search Report and Written Opinion in International Appln. No. PCT/US2018/065199, dated Jul. 23, 2019, 35 pages.
GCC Examination Report in GCC Appln. No. GC 2018-36649, dated May 16, 2020, 5 pages.
GCC Examination Report in GCC Appln. No. GC 2018-36636, dated May 16, 2020, 5 pages.
GCC Examination Report in GCC Appln. No. GC 2018-36644, dated May 16, 2020, 6 pages.
GCC Examination Report in GCC Appln. No. GC 2018-36642, dated May 16, 2020, 7 pages.
GCC Examination Report in GCC Appln. No. GC 2018-36650, dated Jun. 27, 2020, 4 pages.
GCC Examination Report in GCC Appln. No. GC 2018-36653, dated Jun. 20, 2020, 4 pages.
GCC Examination Report in GCC Appln. No. GC 2018-36655, dated Jun. 27, 2020, 5 pages.
GCC Examination Report in GCC Appln. No. GC 2018-36641, dated Aug. 31, 2020, 4 pages.
GCC Examination Report in GCC Appln. No. GC 2018-36648, dated Aug. 31, 2020, 5 pages.
GCC Examination Report in GCC Appln. No. GC 2018-36636, dated Aug. 31, 2020, 4 pages.
GCC Examination Report in GCC Appln. No. GC 2018-36642, dated Sep. 12, 2020, 5 pages.
GCC Examination Report in GCC Appln. No. GC 2018-36644, dated Aug. 31, 2020, 5 pages.
GCC Examination Report in GCC Appln. No. GC 2018-36650, dated Oct. 28, 2020, 3 pages.
GCC Examination Report in GCC Appln. No. GC 2018-36653, dated Oct. 30, 2020, 3 pages.
GCC Examination Report in GCC Appln. No. GC 2018-36655, dated Oct. 30, 2020, 3 pages.
GCC Examination Report in GCC Appln. No. GC 2018-36648, dated Dec. 21, 2020, 4 pages.
GCC Examination Report in GCC Appln. No. GC 2018-36649, dated Dec. 20, 2020, 4 pages.
GCC Examination Report in GCC Appln. No. GC 2018-36643, dated Dec. 20, 2020, 4 pages.
GCC Examination Report in GCC Appln. No. GC 2018-36644, dated Feb. 13, 2021, 4 pages.
CN Office Action in Chinese Appln. No. 201880087452.4, dated Sep. 14, 2021, 17 pages, with English Translation.

* cited by examiner

PROCESS INTEGRATION FOR NATURAL GAS LIQUID RECOVERY

CROSS-REFERENCE TO RELATED APPLICATIONS

This application claims the benefit of priority to U.S. Provisional Application Ser. No. 62/599,509, filed on Dec. 15, 2017, and entitled "PROCESS INTEGRATION FOR NATURAL GAS LIQUID RECOVERY," the contents of which are hereby incorporated by reference.

TECHNICAL FIELD

This specification relates to operating industrial facilities, for example, hydrocarbon refining facilities or other industrial facilities that include operating plants that process natural gas or recover natural gas liquids.

BACKGROUND

Petroleum refining processes are chemical engineering processes used in petroleum refineries to transform raw hydrocarbons into various products, such as liquid petroleum gas (LPG), gasoline, kerosene, jet fuel, diesel oils, and fuel oils. Petroleum refineries are large industrial complexes that can include several different processing units and auxiliary facilities, such as utility units, storage tank farms, and flares. Each refinery can have its own unique arrangement and combination of refining processes, which can be determined, for example, by the refinery location, desired products, or economic considerations. The petroleum refining processes that are implemented to transform the raw hydrocarbons into products can require heating and cooling. Various process streams can exchange heat with a utility stream, such as steam, a refrigerant, or cooling water, in order to heat up, vaporize, condense, or cool down. Process integration is a technique for designing a process that can be utilized to reduce energy consumption and increase heat recovery. Increasing energy efficiency can potentially reduce utility usage and operating costs of chemical engineering processes.

SUMMARY

This document describes technologies relating to process integration of natural gas liquid recovery systems and associated refrigeration systems.

This document includes one or more of the following units of measure with their corresponding abbreviations, as shown in Table 1:

TABLE 1

| Unit of Measure | Abbreviation |
|---|---|
| Degrees Fahrenheit (temperature) | ° F. |
| Rankine (temperature) | R |
| Megawatt (power) | MW |
| Percent | % |
| One million | MM |
| British thermal unit (energy) | Btu |
| Hour (time) | h |
| Second (time) | s |
| Kilogram (mass) | kg |
| Iso-(molecular isomer) | i- |
| Normal-(molecular isomer) | n- |

Certain aspects of the subject matter described here can be implemented as a natural gas liquid recovery system. The natural gas liquid recovery system includes a cold box and a refrigeration system configured to receive heat through the cold box. The cold box includes a plate-fin heat exchanger including compartments. The cold box is configured to transfer heat from hot fluids in the natural gas liquid recovery system to cold fluids in the natural gas liquid recovery system. The refrigeration system includes a primary refrigerant loop in fluid communication with the cold box. The primary refrigerant loop includes a primary refrigerant including a first mixture of hydrocarbons.

This, and other aspects, can include one or more of the following features.

The hot fluids can include a feed gas to the natural gas liquid recovery system. The feed gas can include a second mixture of hydrocarbons.

The cold box can include a chill down train configured to condense at least a portion of the feed gas in at least one compartment of the cold box. The chill down train can include a separator in fluid communication with the cold box. The separator can be positioned downstream of the cold box. The separator can be configured to separate the feed gas into a liquid phase and a refined gas phase.

The natural gas liquid recovery system can include a de-methanizer column in fluid communication with the cold box. The de-methanizer column can be configured to receive at least one hydrocarbon stream and separate the at least one hydrocarbon stream into a vapor stream and a liquid stream. The vapor stream can include a sales gas including predominantly of methane. The liquid stream can include a natural gas liquid including predominantly of hydrocarbons heavier than methane.

The sales gas including predominantly of methane can include at least 89 mol % of methane. The natural gas liquid including predominantly of hydrocarbons heavier than methane can include at least 99.5 mol % of hydrocarbons heavier than methane.

The natural gas liquid recovery system can include a gas dehydrator positioned downstream of the chill down train. The gas dehydrator can be configured to remove water from the refined gas phase.

The gas dehydrator can include a molecular sieve.

The natural gas liquid recovery system can include a liquid dehydrator positioned downstream of the chill down train. The liquid dehydrator can be configured to remove water from the liquid phase.

The liquid dehydrator can include a bed of activated alumina.

The natural gas liquid recovery system can include a feed pump configured to send a hydrocarbon liquid to the de-methanizer column. The natural gas liquid recovery system can include a natural gas liquid pump configured to send natural gas liquid from the de-methanizer column. The natural gas liquid recovery system can include a storage system configured to hold a portion of natural gas liquid from the de-methanizer column.

The primary refrigerant can include a mixture on a mole fraction basis of 63% to 77% of $C_2$ hydrocarbon, 12% to 18% of $C_3$ hydrocarbon, 3% to 11% of $C_4$ hydrocarbon, and 3% to 14% of $C_5$ hydrocarbon.

The refrigeration system can include a refrigerant separator configured to separate the primary refrigerant into a primary refrigerant liquid and a primary refrigerant vapor. The primary refrigerant liquid and the primary refrigerant vapor can be provided to the cold box.

The refrigeration system can include a compressor configured to receive and increase pressure of fluids from the cold box.

Certain aspects of the subject matter described here can be implemented as a method for recovering natural gas liquid from a feed gas. Heat from hot fluids is transferred to cold fluids through a cold box. The cold box includes a plate-fin heat exchanger including compartments. Heat is transferred to a refrigeration system through the cold box. The refrigeration system includes a primary refrigerant loop in fluid communication with the cold box. The primary refrigerant loop includes a primary refrigerant including a first mixture of hydrocarbons.

This, and other aspects, can include one or more of the following features.

The cold box can include a chill down train including a separator in fluid communication with and downstream of the cold box.

The primary refrigerant can include a mixture on a mole fraction basis of 63% to 77% of $C_2$ hydrocarbon, 12% to 18% of $C_3$ hydrocarbon, 3% to 11% of $C_4$ hydrocarbon, and 3% to 14% of $C_5$ hydrocarbon.

The hot fluids can include the feed gas including a second mixture of hydrocarbons.

At least a portion of the feed gas can be condensed in at least one compartment of the cold box. The feed gas can be separated into a liquid phase and a refined gas phase using the separator.

At least one hydrocarbon stream can be received in a de-methanizer column in fluid communication with the cold box. The at least one hydrocarbon stream can be separated into a vapor stream and a liquid stream. The vapor stream can include a sales gas including predominantly of methane. The liquid stream can include a natural gas liquid including predominantly of hydrocarbons heavier than methane.

The sales gas including predominantly of methane can include at least 89 mol % of methane. The natural gas liquid including predominantly of hydrocarbons heavier than methane can include at least 99.5 mol % of hydrocarbons heavier than methane.

Water can be removed from the refined gas phase using a gas dehydrator including a molecular sieve.

Water can be removed from the liquid phase using a liquid dehydrator including a bed of activated alumina.

A hydrocarbon liquid can be sent to the de-methanizer column using a feed pump. Natural gas liquid can be sent from the de-methanizer column using a natural gas liquid pump. An amount of natural gas liquid from the de-methanizer column can be stored in a storage system.

Certain aspects of the subject matter described here can be implemented as a system. The system includes a cold box including compartments. Each of the compartments includes one or more thermal passes. The system includes one or more hot process streams. Each of the one or more hot process streams flow through one or more of the compartments. The system includes one or more cold process streams. Each of the one or more cold process streams flow through one or more of the compartments. The system includes one or more refrigerant streams. Each of the one or more refrigerant streams flow through one or more of the compartments. In each of the one or more thermal passes of each of the compartments, one of the one or more hot process streams transfers heat to at least one of the one or more cold process streams or the one or more refrigerant streams. For each of the compartments, a number of potential passes is equal to a product of A) a total number of hot process streams flowing through the respective compartment and B) a total number of cold process streams and refrigerant streams flowing through the respective compartment. For each of the compartments, a number of thermal passes is equal to the number of potential passes of the respective compartment.

This, and other aspects, can include one or more of the following features.

The one or more hot process streams can include a first hot process stream, a second hot process stream, and a third hot process stream. Only one of the first, second, or third hot process streams flow through any given one of the compartments.

Within the cold box, at least one of the one or more hot process streams can transfer heat to each of the one or more cold process streams and the one or more refrigerant streams.

The one or more cold process streams can include a first cold process stream and a second cold process stream. The first cold process stream can be the only stream that flows through only one of the compartments.

The second cold process stream can be the only stream that flows through all of the compartments.

The one or more refrigerant streams can include a first refrigerant stream and a second refrigerant stream. The first and second refrigerant streams can be different phases from a single mixed refrigerant stream. Each of the first and second refrigerants streams can have compositions different from each other and from the single mixed refrigerant stream. Each of the first and second refrigerant streams can flow through the same one or more of the compartments.

A total number of compartments can be 10, and a total number of thermal passes of the compartments of the cold box can be 36.

The details of one or more implementations of the subject matter described in this specification are set forth in the accompanying drawings and the detailed description. Other features, aspects, and advantages of the subject matter will become apparent from the description, the drawings, and the claims.

DETAILED DESCRIPTION

NGL Recovery System

Figure 1A:
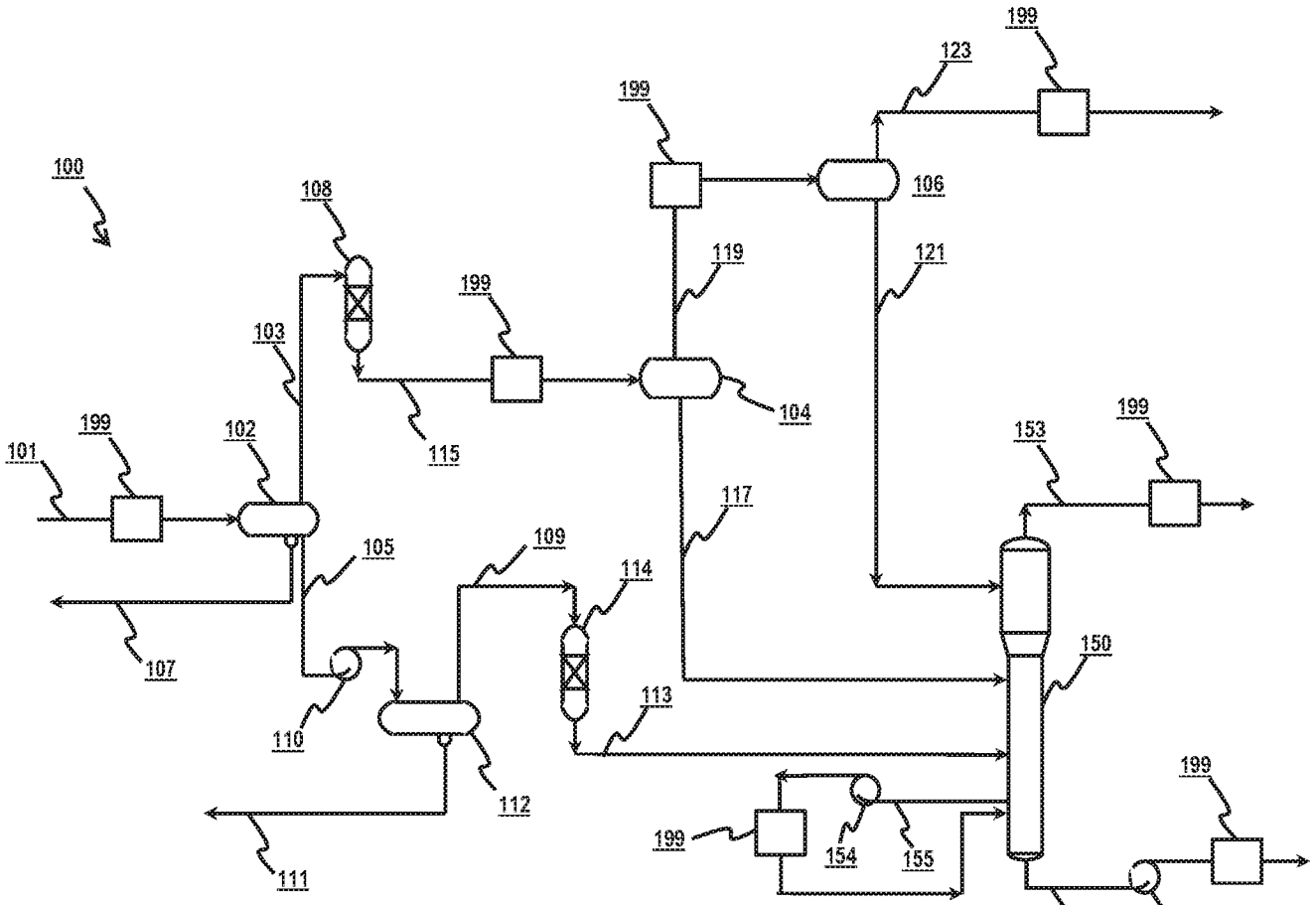
FIG. 1A is a schematic diagram of an example of a liquid recovery system, according to the present disclosure.

Gas processing plants can purify raw natural gas or crude oil production associated gases (or both) by removing common contaminants such as water, carbon dioxide, and hydrogen sulfide. Some of the contaminants have economic value and can be processed, sold, or both. Once the contaminants have been removed, the natural gas (or feed gas) can be cooled, compressed, and fractionated in the liquid recovery and sales gas compression section of a gas processing plant. Upon the separation of methane gas, which is useful as sales gas for houses and power generation, the remaining hydrocarbon mixture in liquid phase is called natural gas liquids (NGL). The NGL can be fractionated in a separate plant or sometimes in the same gas processing plant into ethane, propane and heavier hydrocarbons for several versatile uses in chemical and petrochemical processes as well as transportation industries.

The liquid recovery section of a gas processing plant includes one or more chill-down trains—three, for example—to cool and dehydrate the feed gas and a de-methanizer column to separate the methane gas from the heavier hydrocarbons in the feed gas such as ethane, propane, and butane. The liquid recovery section can optionally include a turbo-expander. The residue gas from the liquid recovery section includes the separated methane gas from the de-methanizer and is the final, purified sales gas which is pipelined to the market.

The liquid recovery process can be heavily heat integrated in order to achieve a desired energy efficiency associated with the system. Heat integration can be achieved by matching relatively hot streams to relatively cold streams in the process in order to recover available heat from the process. The transfer of heat can be achieved in individual heat exchangers—shell-and-tube, for example—located in several areas of the liquid recovery section of the gas processing plant, or in a cold box, where multiple relatively hot streams provide heat to multiple relatively cold streams in a single unit.

In some implementations, the liquid recovery system can include a cold box, a first chill down separator, a second chill down separator, a third chill down separator, a feed gas dehydrator, a liquid dehydrator feed pump, a de-methanizer feed coalescer, a liquid dehydrator, a de-methanizer, and a de-methanizer bottom pump. The liquid recovery system can optionally include a de-methanizer reboiler pump.

The first chill down separator is a vessel that can operate as a 3-phase separator to separate the feed gas into water, liquid hydrocarbon, and vapor hydrocarbon streams. The second chill down separator and third chill down separator are vessels that can separate feed gas into liquid and vapor phases. The feed gas dehydrator is a vessel and can include internals to remove water from the feed gas. In some implementations, the feed gas dehydrator includes a molecular sieve bed. The liquid dehydrator feed pump can pressurize the liquid hydrocarbon stream from the first chill down separator and can send fluid to the de-methanizer feed coalescer, which is a vessel that can remove entrained water carried over in the liquid hydrocarbon stream past the first chill down separator. The liquid dehydrator is a vessel and can include internals to remove any remaining water in the liquid hydrocarbon stream. In some implementations, the liquid dehydrator includes a bed of activated alumina. The de-methanizer is a vessel and can include internal components, for example, trays or packing, and can effectively serve as a distillation tower to boil off methane gas. The de-methanizer bottom pump can pressurize the liquid from the bottom of the de-methanizer and can send fluid to storage, for example, tanks or spheres. The de-methanizer reboiler pump can pressurize the liquid from the bottom of the de-methanizer and can send fluid to a heat source, for example, a typical heat exchanger or a cold box.

Liquid recovery systems can optionally include auxiliary and variant equipment such as additional heat exchangers and vessels. The transport of vapor, liquid, and vapor-liquid mixtures within, to, and from the liquid recovery system can be achieved using various piping, pump, and valve configurations. In this disclosure, "approximately" means a deviation or allowance of up to 10%, and any variation from a mentioned value is within the tolerance limits of any machinery used to manufacture the part.

Cold Box

A cold box is a multi-stream, plate-fin heat exchanger. For example, in some aspects, a cold box is a plate-fin heat exchanger with multiple (for example, more than two) inlets and a corresponding number of multiple (for example, more than two) outlets. Each inlet receives a flow of a fluid (for example, a liquid) and each outlet outputs a flow of a fluid (for example, a liquid). Plate-fin heat exchangers utilize plates and finned chambers to transfer heat between fluids. The fins of such heat exchangers can increase the surface area to volume ratio, thereby increasing effective heat transfer area. Plate-fin heat exchangers can therefore be relatively compact in comparison to other typical heat exchangers that exchange heat between two or more fluid flows (for example, shell-and-tube).

A plate-fin cold box can include multiple compartments that segment the exchanger into multiple sections. Fluid streams can enter and exit the cold box, traversing the cold box through the one or more compartments that together make up the cold box.

In traversing a particular compartment, one or more hot fluids traversing the compartment communicates heat to one or more cold streams traversing the compartment, thereby "passing" heat from the hot fluid(s) to the cold fluid(s). In the context of this disclosure, a "pass" refers to the transfer of heat from a hot stream to a cold stream within a compartment. One may think of the total amount of heat passing from a particular hot stream to a particular cold stream as a singular "thermal pass". Although the configuration of any given compartment may have one or more "physical passes", that is, a number of times the fluid physically traverses the compartment from a first end (where the fluid enters the compartment) to another end (where the fluid exits the compartment) to effect the "thermal pass", the physical configuration of the compartment is not the focus of this disclosure.

Each cold box and each compartment within the cold box can include one or more thermal passes. Each compartment can be viewed as its own individual heat exchanger with the series of compartments in fluid communication with one another making up the totality of the cold box. Therefore, the number of heat exchanges for the cold box is the sum of the number of thermal passes that occur in each compartment. The number of thermal passes in each compartment potentially is the product of the number of hot fluids entering and exiting the compartment times the number of cold fluids entering and exiting the compartment.

A simple version of a cold box can serve an example for determining the number of potential passes for a cold box. For example, a cold box comprising three compartments has two hot fluids (hot 1 and hot 2) and three cold fluids (cold 1, cold 2, and cold 3) entering and exiting the cold box. Hot 1 and cold 1 traverse the cold box between the first compartment and the third compartment, hot 2 and cold 2 traverse the cold box between the second and third compartment, and cold 3 traverses the cold box between the first and second compartment. Using this example, the first compartment has two thermal passes: hot 1 passes thermal energy to cold 1 and cold 3; the second compartment has six passes: hot 1 passes heat to cold 1, cold 2, and cold 3, and hot 2 also passes heat to cold 1, cold 2, and cold 3; and the third compartment has four passes: hot 1 passes heat to cold 1 and cold 2, and hot 2 also passes heat to cold 1 and cold 2. Therefore, on a compartment basis, the number of thermal passes that can be present in the example cold box is the sum of the individual products of each compartment (2, 6 and 4), or 12 thermal passes. This is the maximum number of thermal passes that can be present in the example cold box based upon its configuration of entries and exits from the various compartments. The determination assumes that all the hot streams and all the cold streams in each compartment are in thermal communication with each other.

In some implementations of the systems, methods, and cold boxes, the number of thermal passes is equal to or less than the maximum number of potential passes for a cold box. In some such instances, a hot stream and a cold stream may traverse a compartment (and therefore be counted as a potential pass using the compartment basis method); however, heat from the hot stream is not transferred to the cold stream. In such an instance, the number of thermal passes for such a compartment would be less than the number of potential passes. As well, the number of thermal passes for such a cold box would be less than the number of potential passes.

Using the prior example but with a modification, this can be demonstrated. With the stipulation to the example cold box that there is a mitigation technique or device that inhibits the transfer of thermal energy in the second compartment from hot 2 to cold 2, the number of thermal passes for second compartment is no longer six; it is now five. With such a reduction, the total thermal passes for the cold box is now eleven, not twelve, as previously determined.

In some implementations, a compartment may have fewer thermal passes than the number of potential passes. In some implementations, the number of thermal passes in a compartment may be fewer than the number of potential passes by one, two, three, four, five, or more. In some implementations, the number of thermal passes in a cold box may have fewer than the number of potential passes for the cold box.

The cold box can be fabricated in horizontal or vertical configurations to facilitate transportation and installation. The implementation of cold boxes can also potentially reduce heat transfer area, which in turn reduces required plot space in field installations. The cold box, in certain implementations, includes a thermal design for the plate-fin heat exchanger to handle a majority of the hot streams to be cooled and the cold streams to be heated in the liquid recovery process, thus allowing for cost avoidance associated with interconnecting piping, which would be required for a system utilizing multiple, individual heat exchangers that each include only two inlets and two outlets.

In certain implementations, the cold box includes alloys that allow for low temperature service. An example of such an alloy is aluminum alloy, brazed aluminum, copper, or brass. Aluminum alloys can be used in low temperature service (less than −100° F., for example) and can be relatively lighter than other alloys, potentially resulting in reduced equipment weight. The cold box can handle single-phase liquid, single-phase gaseous, vaporizing, and condensing streams in the liquid recovery process. The cold box can include multiple compartments, for example, ten compartments, to transfer heat between streams. The cold box can be specifically designed for the required thermal and hydraulic performance of a liquid recovery system, and the hot process streams, cold process streams, and refrigerant streams can be reasonably considered as clean fluids that do not contain contaminants that can cause fouling or erosion, such as debris, heavy oils, asphalt components, and polymers. The cold box can be installed within a containment with interconnecting piping, vessels, valves, and instrumentation, all included as a packaged unit, skid, or module. In certain implementations, the cold box can be supplied with insulation.

Chill Down Trains

The feed gas travels through at least one chill down train, each train including cooling and liquid-vapor separation, to cool the feed gas and facilitate the separation of light hydrocarbons from heavier hydrocarbons. For example, the feed gas travels through three chill down trains. Feed gas at a temperature in a range of approximately 130° F. to 170° F. flows to the cold box which cools the feed gas down to a temperature in a range of approximately 70° F. to 95° F. A portion of the feed gas condenses through the cold box, and the multi-phase fluid enters a first chill down separator that separates feed gas into three phases: hydrocarbon feed gas, condensed hydrocarbon liquid, and water. Water can flow to storage, such as a process water recovery drum where the water can be used, for example, as make-up in a gas treating unit. In subsequent chill down trains, the separator can separate a fluid into two phases: hydrocarbon gas and hydrocarbon liquid. As the feed gas travels through each chill down train, the feed gas can be refined. In other words, as the feed gas is cooled down in a chill down train, the heavier components in the gas can condense while the lighter components can remain in the gas. Therefore, the gas exiting the separator can have a lower molecular weight than the gas entering the chill down train.

Condensed hydrocarbons from the first chill down train, also referred to as first chill down liquid, is pumped from the first chill down separator by one or more liquid dehydrator feed pumps. In certain implementations, the liquid can have enough available pressure to be passed downstream with a valve instead of using a pump to pressurize the liquid. First chill down liquid travels through a de-methanizer feed coalescer to remove any free water entrained in the first chill down liquid to avoid damage to downstream equipment, for example, a liquid dehydrator. Removed water can flow to storage, such as a condensate surge drum. Remaining first chill down liquid can be sent to one or more liquid dehydrators, for example, a pair of liquid dehydrators, in order further remove water and any hydrates that may be present in the liquid.

Hydrates are crystalline substances formed by associated molecules of hydrogen and water, having a crystalline structure. Accumulation of hydrates in a gas pipeline can choke (and in some cases, completely block) piping and cause damage to the system. Dehydration aims for the depression of the dew point of water to less than the minimum temperature that can be expected in the gas pipeline. Gas dehydration can be categorized as absorption (dehydration by liquid media) and adsorption (dehydration by solid media). Glycol dehydration is a liquid-based desiccant system for the removal of water from natural gas and NGLs. In cases where large gas volumes are transported, glycol dehydration can be an efficient and economical way to prevent hydrate formation in the gas pipeline.

Drying in the liquid dehydrators can include passing the liquid through, for example, a bed of activated alumina oxide or bauxite with 50% to 60% aluminum oxide ($Al_2O_3$) content. In some implementations, the absorption capacity of the bauxite is 4.0% to 6.5% of its own mass. Utilizing bauxite can reduce the dew point of water in the dehydrated gas down to approximately −65° C. Some advantages of bauxite in gas dehydration are small space requirements, simple design, low installation costs, and simple sorbent regeneration. Alumina has a strong affinity for water at the conditions of the first chill down liquid.

Liquid sorbents can be used to dehydrate gas. Desirable qualities of suitable liquid sorbents include high solubility in water, economic viability, and resistance to corrosion. If the sorbent is regenerated, it is desirable for the sorbent to be regenerated easily and for the sorbent to have low viscosity. A few examples of suitable sorbents include diethylene glycol (DEG), triethylene glycol (TEG), and ethylene glycol (MEG). Glycol dehydration can be categorized as absorption or injection schemes. With glycol dehydration in absorption schemes, the glycol concentration can be, for example, approximately 96% to 99% with small losses of glycol. The economic efficiency of glycol dehydration in absorption schemes depends heavily on sorbent losses. In order to reduce sorbent loss, a desired temperature of the desorber (that is, dehydrator) can be strictly maintained to separate water from the gas. Additives can be utilized to prevent potential foaming across the gas-absorbent contact area. With glycol dehydration in injection schemes, the dew point of water can be decreased as the gas is cooled. In such cases, the gas is dehydrated, and condensate also drops out of the cooled gas. Utilization of liquid sorbents for dehydration allows for continuous operation (in contrast to batch or semi-batch operation) and can result in reduced capital and operating costs in comparison to solid sorbents, reduced pressure differentials across the dehydration system in comparison to solid sorbents, and avoidance of the potential poisoning that can occur with solid sorbents.

A hygroscopic ionic liquid (such as methanesulfonate, $CH_3O_3S^-$) can be utilized for gas dehydration. Some ionic liquids can be regenerated with air, and in some cases, the drying capacity of gas utilizing an ionic liquid system can be more than double the capacity of a glycol dehydration system.

Two liquid dehydrators can be installed in parallel: one liquid dehydrator in operation and the other in regeneration of alumina. Once the alumina in one liquid dehydrator is saturated, the liquid dehydrator can be taken off-line and regenerated while the liquid passes through the other liquid dehydrator. Dehydrated first chill down liquid exits the liquid dehydrators and is sent to the de-methanizer. In certain implementations, the first chill down liquid can be sent directly to the de-methanizer from the first chill down separator. Dehydrated first chill down liquid can also pass through the cold box to be cooled further before entering the de-methanizer.

Hydrocarbon feed gas from the first chill down separator, also referred to as first chill down vapor, flows to one or more feed gas dehydrators for drying, for example, three feed gas dehydrators. The first chill down vapor can pass through the demister before entering the feed gas dehydrators. In certain implementations, two of the three gas dehydrators can be on-stream at any given time while the third gas dehydrator is on regeneration or standby. Drying in the gas dehydrators can include passing hydrocarbon gas through a molecular sieve bed. The molecular sieve has a strong affinity for water at the conditions of the hydrocarbon gas. Once the sieve in one of the gas dehydrators is saturated, that gas dehydrator is taken off-stream for regeneration while the previously off-stream gas dehydrator is placed on-stream. Dehydrated first chill down vapor exits the feed gas dehydrators and enters the cold box. In certain implementations, the first chill down vapor can be sent directly to the cold box from the first chill down separator. The cold box can cool dehydrated first chill down vapor down to a temperature in a range of approximately −30° F. to 20° F. A portion of the dehydrated first chill down vapor condenses through the cold box, and the multi-phase fluid enters the second chill down separator. The second chill down separator separates hydrocarbon liquid, also referred to as second chill down liquid, from the first chill down vapor. Second chill down liquid is sent to the de-methanizer. The second chill down liquid can pass through the cold box to be cooled before entering the de-methanizer. The second chill down liquid can optionally combine with the first chill down liquid before entering the de-methanizer.

Gas from the second chill down separator, also referred to as second chill down vapor, flows to the cold box. In certain implementations, the cold box cools the second chill down vapor down to a temperature in a range of approximately −60° F. to −40° F. In certain implementations, the cold box cools the second chill down vapor down to a temperature in a range of approximately −100° F. to −80° F. A portion of the second chill down vapor condenses through the cold box, and the multi-phase fluid enters the third chill down separator. The third chill down separator separates hydrocarbon liquid, also referred to as third chill down liquid, from the second chill down vapor. The third chill down liquid is sent to the de-methanizer.

Gas from the third chill down separator is also referred to as high pressure residue gas. In certain implementations, the high pressure residue gas passes through the cold box and heats up to a temperature in a range of approximately 120° F. to 140° F. In certain implementations, a portion of the high pressure residue gas passes through cold box and cools down to a temperature in a range of approximately −160° F. to −150° F. before entering the de-methanizer. The high pressure residue gas can be pressurized and sold as sales gas.

De-Methanizer

The de-methanizer removes methane from the hydrocarbons condensed out of the feed gas in the cold box and chill down trains. The de-methanizer receives as feed the first chill down liquid, the second chill down liquid, and the third chill down liquid. In certain implementations, an additional feed source to the de-methanizer can include several process vents, such as vent from a propane surge drum, vent from a propane condenser, vents and minimum flow lines from a de-methanizer bottom pump, and surge vent lines from NGL surge spheres. In certain implementations, an additional feed source to the de-methanizer can include high-pressure residue gas from the third chill down separator, the turbo-expander, or both.

The residue gas from the top of the de-methanizer is also referred to as overhead low pressure residue gas. In certain implementations, the overhead low pressure residue gas enters the cold box at a temperature in a range of approximately −170° F. to −150° F. In certain implementations, the overhead low pressure residue gas enters the cold box at a temperature in a range of approximately −120° F. to −100° F. and exits the cold box at a temperature in a range of approximately 20° F. to 40° F. The overhead low pressure residue gas can be pressurized and sold as sales gas.

The de-methanizer bottom pump pressurizes liquid from the bottom of the de-methanizer, also referred to as de-methanizer bottoms, and sends fluid to storage, such as NGL spheres. The de-methanizer bottoms can operate at a temperature in a range of approximately 25° F. to 75° F. The de-methanizer bottoms can optionally pass through the cold box to be heated to a temperature in a range of approximately 85° F. to 105° F. before being sent to storage. The de-methanizer bottoms can optionally pass through a heat exchanger or the cold box to be heated to a temperature in a range of approximately 65° F. to 110° F. after being sent to storage. The de-methanizer bottoms includes hydrocarbons heavier (that is, having a higher molecular weight) than methane and can be referred to as natural gas liquid. Natural gas liquid can be further fractionated into separate hydrocarbon streams, such as ethane, propane, butane, and pentane.

A portion of the liquid at the bottom of the de-methanizer, also referred to as de-methanizer reboiler feed, is routed to the cold box where the liquid is partially or fully boiled and routed back to the de-methanizer. In certain implementations, the de-methanizer reboiler feed flows hydraulically based on the available liquid head at the bottom of the de-methanizer. Optionally, a de-methanizer reboiler pump can pressurize the de-methanizer reboiler feed to provide flow. In certain implementations, the de-methanizer reboiler feed operates at a temperature in a range of approximately 0° F. to 20° F. and is heated in the cold box to a temperature in a range of approximately 20° F. to 40° F. In certain implementations, the de-methanizer reboiler feed is heated in the cold box to a temperature in a range of approximately 55° F. to 75° F. One or more side streams from the de-methanizer can optionally pass through the cold box and return to the de-methanizer.

Turbo-Expander

The liquid recovery system can include a turbo-expander. The turbo-expander is an expansion turbine through which a gas can expand to produce work. The produced work can be used to drive a compressor, which can be mechanically coupled with the turbine. A portion of the high pressure residue gas from the third chill down separator can expand and cool down through the turbo-expander before entering the de-methanizer. The expansion work can be used to compress the overhead low pressure residue gas. In certain implementations, the overhead low pressure residue gas is compressed in the compression portion of the turbo-expander in order to be delivered as sales gas.

Primary Refrigeration System

The liquid recovery process typically requires cooling down to temperatures that cannot be achieved with typical water or air cooling, for example, less than 0° F. Therefore, the liquid recovery process includes a refrigeration system to provide cooling to the process. Refrigeration systems can include refrigeration loops, which involve a refrigerant cycling through evaporation, compression, condensation, and expansion. The evaporation of the refrigerant provides cooling to a process, such as liquid recovery.

The refrigeration system includes a refrigerant, a cold box, a knockout drum, a compressor, an air cooler, a water cooler, a feed drum, a throttling valve, and a separator. The refrigeration system can optionally include additional knockout drums, additional compressors, and additional separators which operate at different pressures to allow for cooling at different temperatures. The refrigeration system can optionally include one or more subcoolers. The additional subcoolers can be located upstream or downstream of the feed drum. The additional subcoolers can transfer heat between streams within the refrigeration system.

Because the refrigerant provides cooling to a process by evaporation, the refrigerant is chosen based on a desired boiling point in comparison to the lowest temperature needed in the process, while also taking into consideration re-compression of the refrigerant. The refrigerant, also referred to as the primary refrigerant, can be a mixture of various non-methane hydrocarbons, such as ethane, ethylene, propane, propylene, n-butane, i-butane, and n-pentane. A $C_2$ hydrocarbon is a hydrocarbon that has two carbon atoms, such as ethane and ethylene. A $C_3$ hydrocarbon is a hydrocarbon that has three carbons, such as propane and propylene. A $C_4$ hydrocarbon is a hydrocarbon that has four carbons, such as an isomer of butane and butene. A $C_5$ hydrocarbon is a hydrocarbon that has five carbons, such as an isomer of pentane and pentene. In certain implementations, the primary refrigerant has a composition of ethane in a range of approximately 1 mol % to 80 mol %. In certain implementations, the primary refrigerant has a composition of ethylene in a range of approximately 1 mol % to 45 mol %. In certain implementations, the primary refrigerant has a composition of propane in a range of approximately 1 mol % to 25 mol %. In certain implementations, the primary refrigerant has a composition of propylene in a range of approximately 1 mol % to 45 mol %. In certain implementations, the primary refrigerant has a composition of n-butane in a range of approximately 1 mol % to 20 mol %. In certain implementations, the primary refrigerant has a composition of i-butane in a range of approximately 2 mol % to 60 mol %. In certain implementations, the primary refrigerant has a composition of n-pentane in a range of approximately 1 mol % to 15 mol %.

The knockout vessel is a vessel located directly upstream of the compressor to knock out any liquid that may be in the stream before it is compressed because the presence of liquid may damage the compressor. The compressor is a mechanical device that increases the pressure of a gas, such as a vaporized refrigerant. In the context of the refrigeration system, the increase in pressure of a refrigerant increases the boiling point, which can allow the refrigerant to be condensed utilizing air, water, another refrigerant, or a combination of these. The air cooler, also referred to as a fin fan heat exchanger or air-cooled condenser, is a heat exchanger that utilizes a fan to flow air over a surface to cool a fluid. In the context of the refrigeration system, the air cooler provides cooling to a refrigerant after the refrigerant has been compressed. The water cooler is a heat exchanger that utilizes water to cool a fluid. In the context of the refrigeration system, the water cooler also provides cooling to a refrigerant after the refrigerant has been compressed. In certain implementations, condensing the refrigerant can be accomplished with one or more air coolers. In certain implementations, condensing the refrigerant can be accomplished with one or more water coolers. The feed drum, also referred to as a feed surge drum, is a vessel that contains a liquid level of refrigerant so that the refrigeration loop can continue to operate even if there exists some deviation in one or more areas of the loop. The throttling valve is a device that direct or controls a flow of fluid, such as a refrigerant. The refrigerant reduces in pressure as the refrigerant travels through the throttling valve. The reduction in pressure can cause the refrigerant to flash—that is, evaporate. The separator is a vessel that separates a fluid into liquid and vapor phases. The liquid portion of the refrigerant can be evaporated in a heat exchanger, for example, a cold box, to provide cooling to a system, such as a liquid recovery system.

The primary refrigerant flows from the feed drum through the throttling valve and reduces in pressure to approximately 1 to 2 bar. The reduction in pressure through the valve causes the primary refrigerant to cool down to a temperature in a range of approximately −100° F. to −10° F. The reduction in pressure through the valve can also cause the primary refrigerant to flash—that is, evaporate—into a two-phase mixture. The primary refrigerant separates into liquid and vapor phases in the separator. The liquid portion of the primary refrigerant flows to the cold box. As the primary refrigerant evaporates, the primary refrigerant provides cooling to another process, such as the natural gas liquid recovery process. The evaporated primary refrigerant exits the cold box at a temperature in a range of approximately 70° F. to 160° F. The evaporated primary refrigerant can mix with the vapor portion of the primary refrigerant from the separator and enter the knockout drum operating at a pressure in a range of approximately 1 to 10 bar. The compressor raises the pressure of the primary refrigerant up to a pressure in a range of approximately 9 to 35 bar. The increase in pressure can cause the primary refrigerant temperature to rise to a temperature in a range of approximately 150° F. to 450° F. The compressor outlet vapor is condensed through the air cooler and a water cooler. In certain implementations, the primary refrigerant vapor is condensed using a multitude of air coolers or water coolers, or both in combination. The combined duty of the air cooler and water cooler can be in a range of approximately 30 to 360 MA/Btu/h. The condensed primary refrigerant downstream of the coolers can have a temperature in a range of approximately 80° F. to 100° F. The primary refrigerant returns to the feed drum to continue the refrigeration cycle. In certain implementations, there can be additional throttling valves, knockout drums, compressors, and separators that handles a portion of the primary refrigerant.

Secondary Refrigeration System

In certain implementations, the refrigeration system includes an additional refrigerant loop that includes a secondary refrigerant, an evaporator, an ejector, a cooler, a throttling valve, and a circulation pump. The additional refrigerant loop can use a secondary refrigerant that is distinct from the primary refrigerant.

The secondary refrigerant can be a hydrocarbon, such as i-butane. The evaporator is a heat exchanger that provides heating to a fluid, for example, the secondary refrigerant. The ejector is a device that converts pressure energy available in a motive fluid to velocity energy, brings in a suction fluid that is at a lower pressure than the motive fluid, and discharges the mixture at an intermediate pressure without the use of rotating or moving parts. The cooler is a heat exchanger that provides cooling to a fluid, for example, the secondary refrigerant. The throttling valve causes the pressure of a fluid, for example, the secondary refrigerant, to reduce as the fluid travels through the valve. The circulation pump is a mechanical device that increases the pressure of a liquid, such as a condensed refrigerant.

This secondary refrigeration loop provides additional cooling in the condensation portion of the refrigeration loop of primary refrigerant. The secondary refrigerant can be split into two streams. One stream can be used for subcooling the primary refrigerant in the subcooler, and the other stream can be used to recover heat from the primary refrigerant in the evaporator located upstream of the air cooler in the primary refrigeration loop. The portion of secondary refrigerant for subcooling the primary refrigerant can travel through the throttling valve to bring down the operating pressure in a range of approximately 2 to 3 bar and an operating temperature in a range of approximately 40° F. to 70° F. To subcool the primary refrigerant, the secondary refrigerant receives heat from the primary refrigerant in the subcooler and heats up to a temperature in a range of approximately 45° F. to 85° F. The portion of secondary refrigerant for recovering heat from the primary refrigerant can be pressurized by the circulation pump and can have an operating pressure in a range of approximately 10 to 20 bar and an operating temperature in a range of approximately 90° F. to 110° F. The secondary refrigerant recovers heat from the primary refrigerant in the evaporator and heats up to a temperature in a range of 170° F. to 205° F. The split streams of secondary refrigerant can mix in the ejector and discharge at an intermediate pressure of approximately 4 to 6 bar and an intermediate temperature in a range of approximately 110° F. to 150° F. The secondary refrigerant can pass through the cooler, for example, a water cooler, and condense into a liquid at approximately 4 to 6 bar and 85° F. to 105° F. The cooling duty of the cooler can be in a range of approximately 60 to 130 MMBtu/h. The secondary refrigerant can split downstream of the cooler into two streams to continue the secondary refrigeration cycle.

Refrigeration systems can optionally include auxiliary and variant equipment such as additional heat exchangers and vessels. The transport of vapor, liquid, and vapor-liquid mixtures within, to, and from the refrigeration system can be achieved using various piping, pump, and valve configurations.

Flow Control System

In each of the configurations described later, process streams (also referred to as "streams") are flowed within each unit in a gas processing plant and between units in the gas processing plant. The process streams can be flowed using one or more flow control systems implemented throughout the gas processing plant. A flow control system can include one or more flow pumps to pump the process streams, one or more flow pipes through which the process streams are flowed, and one or more valves to regulate the flow of streams through the pipes.

In some implementations, a flow control system can be operated manually. For example, an operator can set a flow rate for each pump by changing the position of a valve (open, partially open, or closed) to regulate the flow of the process streams through the pipes in the flow control system. Once the operator has set the flow rates and the valve positions for all flow control systems distributed across the gas processing plant, the flow control system can flow the streams within a unit or between units under constant flow conditions, for example, constant volumetric or mass flow rates. To change the flow conditions, the operator can manually operate the flow control system, for example, by changing the valve position.

In some implementations, a flow control system can be operated automatically. For example, the flow control system can be connected to a computer system to operate the flow control system. The computer system can include a computer-readable medium storing instructions (such as flow control instructions) executable by one or more processors to perform operations (such as flow control operations). For example, an operator can set the flow rates by setting the valve positions for all flow control systems distributed across the gas processing plant using the computer system. In such implementations, the operator can manually change the flow conditions by providing inputs through the computer system. In such implementations, the computer system can automatically (that is, without manual intervention) control one or more of the flow control systems, for example, using feedback systems implemented in one or more units and connected to the computer system. For example, a sensor (such as a pressure sensor or temperature sensor) can be connected to a pipe through which a process stream flows. The sensor can monitor and provide a flow conditions (such as a pressure or temperature) of the process stream to the computer system. In response to the flow condition deviating from a set point (such as a target pressure value or target temperature value) or exceeding a threshold (such as a threshold pressure value or threshold temperature value), the computer system can automatically perform operations. For example, if the pressure or temperature in the pipe exceeds the threshold pressure value or the threshold temperature value, respectively, the computer system can provide a signal to open a valve to relieve pressure or a signal to shut down process stream flow.

In some implementations, the techniques described here can be implemented using a cold box that integrates heat exchange across various process streams and refrigerant streams in a gas processing plant, and is presented to enable any person skilled in the art to make and use the disclosed subject matter in the context of one or more particular implementations. Various modifications, alterations, and permutations of the disclosed implementations can be made and will be readily apparent to those or ordinary skill in the art, and the general principles defined may be applied to other implementations and applications, without departing from scope of the disclosure. In some instances, details unnecessary to obtain an understanding of the described subject matter may be omitted so as to not obscure one or more described implementations with unnecessary detail and inasmuch as such details are within the skill of one of ordinary skill in the art. The present disclosure is not intended to be limited to the described or illustrated implementations, but to be accorded the widest scope consistent with the described principles and features.

The subject matter described in this specification can be implemented in particular implementations, so as to realize one or more of the following advantages. A cold box can reduce the total heat transfer area required for the NGL recovery process and can replace multiple heat exchangers, thereby reducing the required amount of plot space and material costs. The refrigeration system can use less power associated with compressing the refrigerant streams in comparison to conventional refrigeration systems, thereby reducing operating costs. Using a mixed hydrocarbon refrigerant can potentially reduce the number of refrigeration cycles (in comparison to a refrigeration system that uses multiple cycles of single component refrigerants), thereby reducing the amount of equipment in the refrigeration system. Process intensification of both the NGL recovery system and the refrigeration system can result in reduced maintenance, operation, and spare parts costs. Other advantages will be apparent to those of ordinary skill in the art.

Referring to FIG. 1A, a liquid recovery system 100 can separate methane gas from heavier hydrocarbons in a feed gas 101. The feed gas 101 can travel through one or more chill down trains (for example, three), each train including cooling and liquid-vapor separation, to cool the feed gas 101. Feed gas 101 flows to a cold box 199, which can cool the feed gas 101. A portion of the feed gas 101 can condense through the cold box 199, and the multi-phase fluid enters a first chill down separator 102 that can separate feed gas 101 into three phases: hydrocarbon feed gas 103, condensed hydrocarbons 105, and water 107. Water 107 can flow to storage, such as a process water recovery drum where the water can be used, for example, as make-up in a gas treating unit.

Condensed hydrocarbons 105, also referred to as first chill down liquid 105, can be pumped from the first chill down separator 102 by one or more liquid dehydrator feed pumps 110. First chill down liquid 105 can be pumped through a de-methanizer feed coalescer 112 to remove any free water entrained in the first chill down liquid 105. Removed water 111 can flow to storage, such as a condensate surge drum. Remaining first chill down liquid 109 can flow to one or more liquid dehydrators 114, for example, a pair of liquid dehydrators. Dehydrated first chill down liquid 113 exits the liquid dehydrators 114 and can flow to a de-methanizer 150.

Hydrocarbon feed gas 103 from the first chill down separator 102, also referred to as first chill down vapor 103, can flow to one or more feed gas dehydrators 108 for drying, for example, three feed gas dehydrators. The first chill down vapor 103 can flow through a demister (not shown) before entering the feed gas dehydrators 108. Dehydrated first chill down vapor 115 exits the feed gas dehydrators 108 and can enter the cold box 199. The cold box 199 can cool dehydrated first chill down vapor 115. A portion of the dehydrated first chill down vapor 115 can condense through the cold box 199, and the multi-phase fluid enters a second chill down separator 104. The second chill down separator 104 can separate hydrocarbon liquid 117, also referred to as second chill down liquid 117, from the gas 119. The second chill down liquid 117 can flow to the de-methanizer 150.

Gas 119 from the second chill down separator 104, also referred to as second chill down vapor 119, can flow to the cold box 199. The cold box 199 can cool the second chill down vapor 119. A portion of the second chill down vapor 119 can condense through the cold box 199, and the multi-phase fluid enters a third chill down separator 106. The third chill down separator 106 can separate hydrocarbon liquid 121, also referred to as third chill down liquid 121, from gas 123. The third chill down liquid 121 can flow to the de-methanizer 150.

Gas 123 from the third chill down separator 106 is also referred to as high pressure (HP) residue gas 123. The HP residue gas 123 can flow through the cold box 199 and be heated. The HP residue gas 123 can be pressurized and sold as sales gas.

The de-methanizer 150 can receive as feed the first chill down liquid 113, the second chill down liquid 117, and the third chill down liquid 121. An additional feed source to the de-methanizer 150 can include one or more process vents, such as vent from a propane surge drum, vent from a propane condenser, vents and minimum flow lines from a de-methanizer bottom pump, and surge vent lines from NGL surge spheres. Residue gas from the top of the de-methanizer 150 is also referred to as overhead low pressure (LP) residue gas 153. The overhead LP residue gas 153 can be heated as the overhead LP residue gas 153 flows through the cold box 199. The overhead LP residue gas 153 can be pressurized and sold as sales gas. The sales gas can be predominantly made up of methane (for example, at least 89 mol % of methane).

A de-methanizer bottom pump 152 can pressurize liquid 151 from the bottom of the de-methanizer 150, also referred to as de-methanizer bottoms 151, and send fluid to storage, such as an NGL sphere. The de-methanizer bottoms 151 can flow through the cold box 199 to be heated before being sent to storage. The de-methanizer bottoms 151 can also be referred to as natural gas liquid and can be predominantly made up of hydrocarbons heavier than methane (for example, at least 99.5 mol % of hydrocarbons heavier than methane).

A portion of the liquid at the bottom of the de-methanizer 150, also referred to as de-methanizer reboiler feed 155, can flow to the cold box 199 where the liquid can be partially or fully vaporized and routed back to the de-methanizer 150. A de-methanizer reboiler pump 154 can pressurize the de-methanizer reboiler feed 155 to provide flow. The de-methanizer reboiler feed 155 can exit the de-methanizer 150 and be heated in the cold box 199.

Figure 1B:
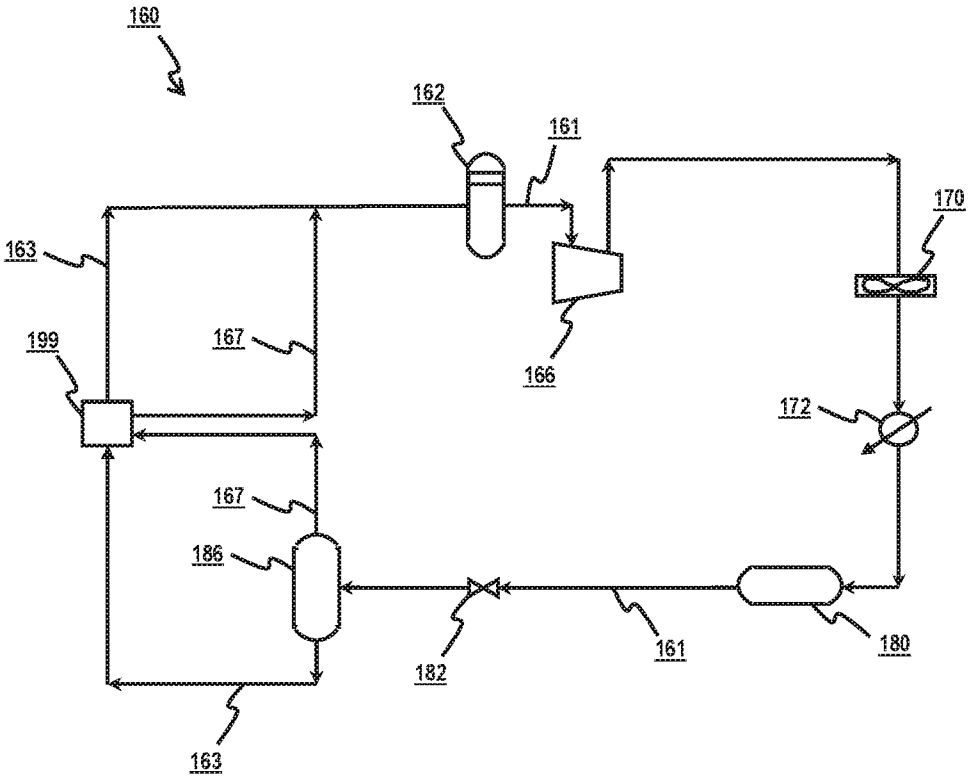
FIG. 1B is a schematic diagram of an example of a refrigeration system for a liquid recovery system, according to the present disclosure.

The liquid recovery process 100 of FIG. 1A can include a refrigeration system 160 to provide cooling, as shown in FIG. 1B. A primary refrigerant 161 in the refrigeration system 160 can be a mixture of $C_2$ hydrocarbons (71 mol % to 81 mol %), $C_3$ hydrocarbons (9 mol % to 19 mol %), $C_4$ hydrocarbons (0.1 mol % to 10 mol %), and $C_5$ hydrocarbons (0.1 mol % to 10 mol %). In a specific example, the primary refrigerant 161 is composed of 75.7 mol % ethane, 16.3 mol % propylene, 2.0 mol % n-butane, 2.0 mol % i-butane, and 4.0 mol % n-pentane. Approximately 70 to 75 kg/s of the primary refrigerant 161 can flow from a feed drum 180 through a throttling valve 182 and decrease in pressure to approximately 1 to 2 bar. The decrease in pressure through the valve 182 can cause the primary refrigerant 161 to be cooled to a temperature in a range of approximately −100° F. to −80° F. The decrease in pressure through the valve 182 can also cause the primary refrigerant 161 to flash—that is, evaporate—into a two-phase mixture. The primary refrigerant 161 can be separated into liquid and vapor phases in a separator 186.

A liquid phase 163 of the primary refrigerant 161, also referred to as primary refrigerant liquid 163, can have a composition that differs from the composition of the primary refrigerant 161. The primary refrigerant liquid 163 can be a mixture of ethane (40 mol % to 50 mol %), propylene (25 mol % to 35 mol %), n-butane (3 mol % to 10 mol %), butane (1 mol % to 10 mol %), and n-pentane (5 mol % to 15 mol %). In a specific example, the primary refrigerant liquid 163 is composed of 45.4 mol % ethane, 31.5 mol % propylene, 5.7 mol % n-butane, 5.5 mol % i-butane, and 11.9 mol % n-pentane. The primary refrigerant liquid 163 can flow from the separator 186 to the cold box 199, for instance, at a flow rate of approximately 25 to 35 kg/s. As the primary refrigerant liquid 163 evaporates in the cold box 199, the primary refrigerant liquid 163 can provide cooling to the liquid recovery process 100. The primary refrigerant liquid 163 can exit the cold box 199 as mostly vapor at a temperature in a range of approximately 70° F. to 90° F.

A vapor phase 167 of the primary refrigerant 161, also referred to as primary refrigerant vapor 167, can have a composition that differs from the composition of the primary refrigerant 161. The primary refrigerant vapor 167 can be a mixture of ethane (85 mol % to 95 mol %), propylene (5 mol % to 15 mol %), n-butane (0 mol % to 1 mol %), butane (0 mol % to 1 mol %), and n-pentane (0 mol % to 1 mol %). In a specific example, the primary refrigerant vapor 167 is composed of 90.9 mol % ethane, 8.7 mol % propylene, 0.1 mol % n-butane, 0.2 mol % i-butane, and 0.0 mol % n-pentane. The primary refrigerant vapor 167 can flow from the separator 186 to the cold box 199, for instance, at a flow rate of approximately 40 to 50 kg/s. As the primary refrigerant vapor 167 is heated in the cold box 199, the primary refrigerant vapor 167 can provide cooling to the liquid recovery process 100. The primary refrigerant vapor 167 can exit the cold box 199 at a temperature in a range of approximately 70° F. to 90° F.

The now-vaporized primary refrigerant liquid 163 from the cold box 199 can mix with the heated primary refrigerant vapor 167 from the cold box 199 to reform the primary refrigerant 161. The primary refrigerant 161 enters a knockout drum 162 operating at approximately 1 to 2 bar. The primary refrigerant 161 exiting the knockout drum 162 to the suction of a compressor 166 can have a temperature in a range of approximately 60° F. to 100° F. The compressor 166 can use approximately 95-105 MMBtu/h (for instance, approximately 100 MMBtu/h (28.6 MW)) to increase the pressure of the primary refrigerant 161 to a pressure in a range of approximately 30 to 35 bar. The increase in pressure can cause the temperature of the primary refrigerant 161 to increase to a range of approximately 430° F. to 440° F. The primary refrigerant 161 can condense as it flows through an air cooler 170 and a water cooler 172. The combined duty of the air cooler 170 and water cooler 172 can be approximately 175-185 MMBtu/h (for instance, approximately 180 MMBtu/h). The primary refrigerant 161 downstream of the cooler 172 can have a temperature in a range of approximately 80° F. to 90° F. The primary refrigerant 161 can return to the feed drum 180 to continue the refrigeration cycle 160.

Figure 1C:
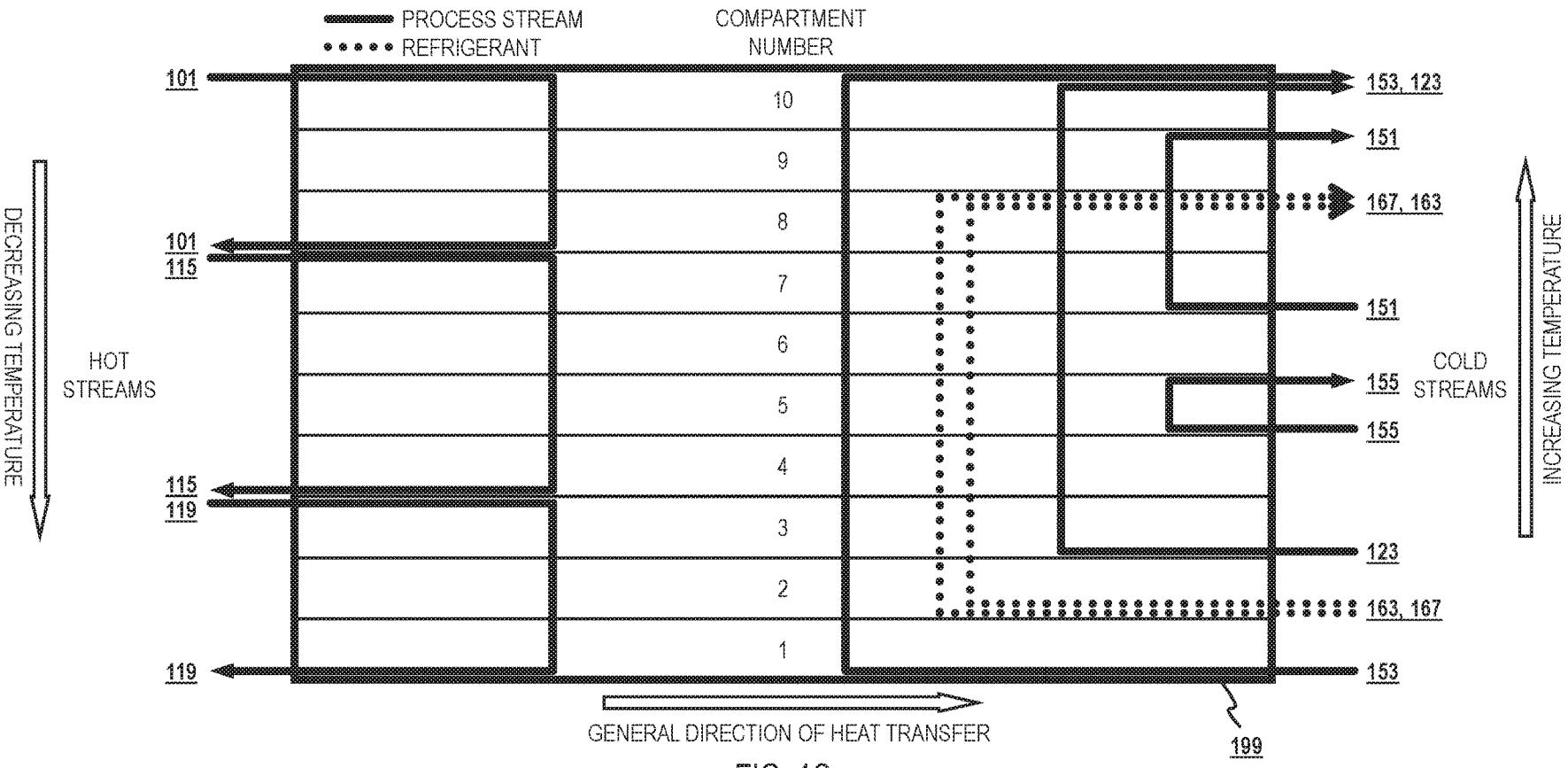
FIG. 1C is a schematic diagram of an example of a cold box, according to the present disclosure.

FIG. 1C illustrates the cold box 199 with a plurality of compartments and the hot and cold streams which include various process streams of the liquid recovery system 100, the primary refrigerant liquid 163, and the primary refrigerant vapor 167. The cold box 199 can include ten compartments and handle heat transfer among various streams, such as at least one hot stream including three process hot streams, at least one cold process streams including four process cold streams, and at least one refrigerant stream including two refrigerant cold streams, each traversing at least one compartment. The two refrigerant cold fluids can include a vapor stream and a liquid stream having different compositions from each other and the primary refrigerant 161. Both refrigerants traverse the same plurality of compartments. In some implementations, heat energy from the three hot streams is recovered by the multiple cold streams and is not expended to the environment. The energy exchange and heat recovery can occur in a single device, such as the cold box 199. The cold box 199 can have a hot side through which the hot streams flow and a cold side through which the cold streams flow. A cold process fluid, a refrigerant fluid, and a hot fluid each traverse at least one compartment of the plurality of compartments. In some implementations, the at least one hot stream comprises at least three hot streams, and the hot streams do not overlap on the hot side such that there is only one hot stream per compartment for the plurality of compartments. One hot stream can exchange heat with one or more cold streams in a single compartment. One hot stream can exchange heat with all of the cold streams. The cold streams can overlap on the cold side such that one or more cold streams flow through a single compartment. One cold process stream, such as the de-methanizer reboiler feed 155, is the only fluid to traverse only one compartment of the plurality of compartments. Multiple cold streams, such as four cold streams (the HP residue gas 123, the LP residue gas 153, the primary refrigerant liquid 163, and the primary refrigerant vapor 167), receive heat from all three hot streams (the feed gas 101, the dehydrated first chill down vapor 115, and the second chill down vapor 119). One cold stream (the LP residue gas 153) is the only fluid that traverses through all ten compartments of the cold box 199. The cold box 199 can have a vertical or horizontal orientation. The cold box 199 temperature profile can decrease in temperature from compartment #10 to compartment #1.

In certain implementations, the feed gas 101 enters the cold box 199 at compartment #10 and exits at compartment #8 to the first chill down separator 102. Across compartments #8 through #10, the feed gas 101 can provide its available thermal duty to various cold streams: the overhead LP residue gas 153 which can enter the cold box 199 at compartment #1 and exit at compartment #10; the HP residue gas 123 which can enter the cold box 199 at compartment #3 and exit at compartment #10; the de-methanizer bottoms 151 which can enter the cold box 199 at compartment #7 and exit at compartment #9; the primary refrigerant liquid 163 which can enter the cold box 199 at compartment #2 and exit at compartment #8; and the primary refrigerant vapor 167 which can enter the cold box 199 at compartment #2 and exit at compartment #8.

In certain implementations, the dehydrated first chill down vapor 115 from the feed gas dehydrator 108 can enter the cold box 199 at compartment #7 and exit at compartment #4 to the second chill down separator 104. Across compartments #4 through #7, the dehydrated first chill down vapor 115 can provide its available thermal duty to various cold streams: the overhead LP residue gas 153 from the de-methanizer 150 which can enter the cold box 199 at compartment #1 and exit at compartment #10; the HP residue gas 123 which can enter the cold box 199 at compartment #3 and exit at compartment #10; the de-methanizer bottoms 151 which can enter the cold box 199 at compartment #7 and exit at compartment #9; the de-methanizer reboiler feed 155 which can enter and exit the cold box 199 at compartment #5; the primary refrigerant liquid 163 which can enter the cold box 199 at compartment #2 and exit at compartment #8; the primary refrigerant vapor 167 which can enter the cold box 199 at compartment #2 and exit at compartment #8. In certain implementations, the dehydrated first chill down vapor 115 provides heat to all of the cold streams.

In certain implementations, the second chill down vapor 119 from the second chill down separator 104 can enter the cold box 199 at compartment #3 and exit at compartment #1 to the third chill down separator 106. Across compartments #1 through #3, the second chill down vapor 119 can provide its available thermal duty to various cold streams: the overhead LP residue gas 153 from the de-methanizer 150 which can enter the cold box 199 at compartment #1 and exit at compartment #10; the HP residue gas 123 which can enter the cold box 199 at compartment #3 and exit at compartment #10; the primary refrigerant liquid 163 which can enter the cold box 199 at compartment #2 and exit at compartment #8; and the primary refrigerant vapor 167 which can enter the cold box 199 at compartment #2 and exit at compartment #8.

The cold box 199 can include 36 thermal passes, which is the same as the number of potential passes as can be determined using the method previously provided. An example of stream data and heat transfer data for the cold box 199 is provided in the following table:

| Compartment Number | Compartment Duty (MMBtu/h) | Pass Number | Pass Duty (MMBtu/h) | Hot Stream Number | Cold Stream Number |
|---|---|---|---|---|---|
| 1 | 1 | 1 | 1 | 119 | 153 |
| 2 | 2 | 2 | 0.2 | 119 | 153 |
| 2 | 2 | 3 | 0.4 | 119 | 167 |
| 2 | 2 | 4 | 1 | 119 | 163 |
| 3 | 29 | 5 | 2 | 119 | 153 |
| 3 | 29 | 6 | 5 | 119 | 167 |
| 3 | 29 | 7 | 7 | 119 | 123 |
| 3 | 29 | 8 | 15 | 119 | 163 |
| 4 | 42 | 9 | 4 | 115 | 153 |
| 4 | 42 | 10 | 7 | 115 | 167 |
| 4 | 42 | 11 | 10 | 115 | 123 |
| 4 | 42 | 12 | 21 | 115 | 163 |
| 5 | 43 | 13 | 1 | 115 | 153 |
| 5 | 43 | 14 | 3 | 115 | 167 |
| 5 | 43 | 15 | 4 | 115 | 123 |
| 5 | 43 | 16 | 8 | 115 | 163 |
| 5 | 43 | 17 | 28 | 115 | 155 |
| 6 | 1 | 18 | 0.1 | 115 | 153 |
| 6 | 1 | 19 | 0.2 | 115 | 167 |
| 6 | 1 | 20 | 0.4 | 115 | 123 |
| 6 | 1 | 21 | 0.7 | 115 | 163 |
| 7 | 17 | 22 | 0.9 | 115 | 153 |
| 7 | 17 | 23 | 2 | 115 | 167 |
| 7 | 17 | 24 | 3 | 115 | 123 |
| 7 | 17 | 25 | 5 | 115 | 151 |
| 7 | 17 | 26 | 6 | 115 | 163 |
| 8 | 31 | 27 | 2 | 101 | 153 |
| 8 | 31 | 28 | 4 | 101 | 167 |
| 8 | 31 | 29 | 5 | 101 | 123 |
| 8 | 31 | 30 | 10 | 101 | 151 |
| 8 | 31 | 31 | 11 | 101 | 163 |
| 9 | 9 | 32 | 1 | 101 | 153 |

-continued

| Compartment Number | Compartment Duty (MMBtu/h) | Pass Number | Pass Duty (MMBtu/h) | Hot Stream Number | Cold Stream Number |
|---|---|---|---|---|---|
| 9 | 9 | 33 | 3 | 101 | 123 |
| 9 | 9 | 34 | 5 | 101 | 151 |
| 10 | 8 | 35 | 2 | 101 | 153 |
| 10 | 8 | 36 | 6 | 101 | 123 |

The total thermal duty of the cold box 199 distributed across its 10 compartments can be approximately 175-185 MMBtu/h (for instance, approximately 183 MMBtu/h), with the refrigeration portion being approximately 75-85 MMBtu/h (for instance, approximately 82 MMBtu/h).

The thermal duty of compartment #1 can be approximately 0.1-10 MMBtu/h (for instance, approximately 1 MMBtu/h). Compartment #1 can have one pass (such as P1) for transferring heat from the second chill down vapor 119 (hot) to the overhead LP residue gas 153 (cold). In certain implementations, the temperature of the hot stream 119 decreases by approximately 0.1° F. to 10° F. through compartment #1. In certain implementations, the temperature of the cold stream 153 increases by approximately 10° F. to 20° F. through compartment #1. The thermal duty for P1 can be approximately 0.8-1.2 MMBtu/h (for instance, approximately 1 MMBtu/h).

The thermal duty of compartment #2 can be approximately 1-10 MMBtu/h (for instance, approximately 2 MMBtu/h). Compartment #2 can have three passes (such as P2, P3, and P4) for transferring heat from the second chill down vapor 119 (hot) to the overhead LP residue gas 153 (cold), the primary refrigerant vapor 167 (cold), and the primary refrigerant liquid 163 (cold), respectively. In certain implementations, the temperature of the hot stream 119 decreases by approximately 0.1° F. to 10° F. through compartment #2. In certain implementations, the temperatures of the cold streams 153, 163, and 167 increase by approximately 0.1° F. to 10° F. through compartment #2. The thermal duties for P2, P3, and P4 can be approximately 0.1-0.3 MMBtu/h (for instance, approximately 0.18 MMBtu/h), 0.8-1.2 MMBtu/h (for instance, approximately 1 MMBtu/h), and 0.3-0.5 MMBtu/h (for instance, approximately 0.4 MMBtu/h), respectively.

The thermal duty of compartment #3 can be approximately 25-35 MMBtu/h (for instance, approximately 29 MMBtu/h). Compartment #3 can have four passes (such as P5, P6, P7, and P8) for transferring heat from the second chill down vapor 119 (hot) to the overhead LP residue gas 153 (cold), the primary refrigerant vapor 167 (cold), the HP residue gas 123 (cold), and the primary refrigerant liquid 163 (cold), respectively. In certain implementations, the temperature of the hot stream 119 decreases by approximately 50° F. to 60° F. through compartment #3. In certain implementations, the temperatures of the cold streams 153, 167, 123, and 163 increase by approximately 35° F. to 45° F. through compartment #3. The thermal duties for P5, P6, P7, and P8 can be approximately 2-3 MMBtu/h (for instance, approximately 2 MMBtu/h), 4-6 MMBtu/h (for instance, approximately 5 MMBtu/h), 6-8 MMBtu/h (for instance, approximately 7 MMBtu/h), and 10-20 MMBtu/h (for instance, approximately 15 MMBtu/h), respectively.

The thermal duty of compartment #4 can be approximately 35-45 MMBtu/h (for instance, approximately 42 MMBtu/h). Compartment #4 can have four passes (such as P9, P10, P11, and P12) for transferring heat from the dehydrated first chill down vapor 115 (hot) to the overhead LP residue gas 153 (cold), the primary refrigerant vapor 167 (cold), the HP residue gas 123 (cold), and the primary refrigerant liquid 163 (cold), respectively. In certain implementations, the temperature of the hot stream 115 decreases by approximately 40° F. to 50° F. through compartment #4. In certain implementations, the temperatures of the cold streams 153, 167, 123, and 163 increase by approximately 55° F. to 65° F. through compartment #4. The thermal duties for P9, P10, P11, and P12 can be approximately 3-5 MMBtu/h (for instance, approximately 4 MMBtu/h), 6-8 MMBtu/h (for instance, approximately 7 MMBtu/h), 9-11 MMBtu/h (for instance, approximately 10 MMBtu/h), and 15-25 MMBtu/h (for instance, approximately 21 MMBtu/h), respectively.

The thermal duty of compartment #5 can be approximately 35-45 MMBtu/h (for instance, approximately 43 MMBtu/h). Compartment #5 can have five passes (such as P13, P14, P15, P16, and P17) for transferring heat from the dehydrated first chill down vapor 115 (hot) to the overhead LP residue gas 153 (cold), the primary refrigerant vapor 167 (cold), the HP residue gas 123 (cold), the primary refrigerant liquid 163 (cold), and the de-methanizer reboiler feed 155 (cold), respectively. In certain implementations, the temperature of the hot stream 115 decreases by approximately 40° F. to 50° F. through compartment #5. In certain implementations, the temperatures of the cold streams 153, 167, 123, 163, and 155 increase by approximately 15° F. to 25° F. through compartment #5. The thermal duties for P13, P14, P15, P16, and P17 can be approximately 0.8-1.2 MMBtu/h (for instance, approximately 1 MMBtu/h), 2-4 MMBtu/h (for instance, approximately 3 MMBtu/h), 3-5 MMBtu/h (for instance, approximately 4 MMBtu/h), 7-9 MMBtu/h (for instance, approximately 8 MMBtu/h), and 25-35 MMBtu/h (for instance, approximately 28 MMBtu/h), respectively.

The thermal duty of compartment #6 can be approximately 0.1-10 MMBtu/h (for instance, approximately 1 MMBtu/h). Compartment #6 can have four passes (such as P18, P19, P20, and P21) for transferring heat from the dehydrated first chill down vapor 115 (hot) to the overhead LP residue gas 153 (cold), the primary refrigerant vapor 167 (cold), the HP residue gas 123 (cold), and the primary refrigerant liquid 163 (cold), respectively. In certain implementations, the temperature of the hot stream 115 decreases by approximately 0.1° F. to 10° F. through compartment #6. In certain implementations, the temperatures of the cold streams 153, 167, 123, and 163 increase by approximately 0.1° F. to 10° F. through compartment #6. The thermal duties for P18, P19, P20, and P21 can be approximately 0.1-0.2 MMBtu/h (for instance, approximately 0.1 MMBtu/h), 0.1-0.3 MMBtu/h (for instance, approximately 0.2 MMBtu/h), 0.3-0.5 MMBtu/h (for instance, approximately 0.4 MMBtu/h), and 0.6-0.8 MMBtu/h (for instance, approximately 0.7 MMBtu/h), respectively.

The thermal duty of compartment #7 can be approximately 10-20 MMBtu/h (for instance, approximately 17 MMBtu/h). Compartment #7 can have five passes (such as P22, P23, P24, P25, and P26) for transferring heat from the dehydrated first chill down vapor 115 (hot) to the overhead LP residue gas 153 (cold), the primary refrigerant vapor 167 (cold), the HP residue gas 123 (cold), the de-methanizer bottoms 151 (cold), and the primary refrigerant liquid 163 (cold). In certain implementations, the temperature of the hot stream 115 decreases by approximately 15° F. to 25° F. through compartment #7. In certain implementations, the temperatures of the cold streams 153, 167, 123, 151, and 163 increase by approximately 10° F. to 20° F. through compartment #7. The thermal duties for P22, P23, P24, P25, and P26 can be approximately 0.8-1.2 MMBtu/h (for instance, approximately 1 MMBtu/h), 1-3 MMBtu/h (for instance, approximately 2 MMBtu/h), 2-4 MMBtu/h (for instance, approximately 3 MMBtu/h), 5-7 MMBtu/h (for instance, approximately 5 MMBtu/h), and 5-7 MMBtu/h (for instance, approximately 6 MMBtu/h), respectively.

The thermal duty of compartment #8 can be approximately 25-35 MMBtu/h (for instance, approximately 31 MMBtu/h). Compartment #8 can have five passes (such as P27, P28, P29, P30, and P31) for transferring heat from the feed gas 101 (hot) to the overhead LP residue gas 153 (cold), the primary refrigerant vapor 167 (cold), the HP residue gas 123 (cold), the de-methanizer bottoms 151 (cold), and the primary refrigerant liquid 163 (cold). In certain implementations, the temperature of the hot stream 101 decreases by approximately 35° F. to 45° F. through compartment #8. In certain implementations, the temperatures of the cold streams 153, 123, 151, and 163 increase by approximately 25° F. to 35° F. through compartment #8. The thermal duties for P27, P28, P29, P30, and P31 can be approximately 1-3 MMBtu/h (for instance, approximately 2 MMBtu/h), 3-5 MMBtu/h (for instance, approximately 4 MMBtu/h), 4-6 MMBtu/h (for instance, approximately 5 MMBtu/h), 9-11 MMBtu/h (for instance, approximately 10 MMBtu/h), and 5-15 MMBtu/h (for instance, approximately 11 MM BTU/h), respectively.

The thermal duty of compartment #9 can be approximately 5-15 MMBtu/h (for instance, approximately 9 MMBtu/h). Compartment #9 can have three passes (such as P32, P33, and P34) for transferring heat from the feed gas 101 (hot) to the overhead LP residue gas 153 (cold), the HP residue gas 123 (cold), and the de-methanizer bottoms 151 (cold). In certain implementations, the temperature of the hot stream 101 decreases by approximately 5° F. to 15° F. through compartment #9. In certain implementations, the temperatures of the cold streams 153, 123, and 151 increase by approximately 10° F. to 20° F. through compartment #9. The thermal duties for P32, P33, and P34 can be approximately 0.8-1.2 MMBtu/h (for instance, approximately 1 MMBtu/h), 2-4 MMBtu/h (for instance, approximately 3 MMBtu/h), and 5-7 MMBtu/h (for instance, approximately 6 MMBtu/h), respectively.

The thermal duty of compartment #10 can be approximately 5-15 MMBtu/h (for instance, approximately 8 MMBtu/h). Compartment #10 can have two passes (such as P35 and P36) for transferring heat from the feed gas 101 (hot) to the overhead LP residue gas 153 (cold) and the HP residue gas 123 (cold). In certain implementations, the temperature of the hot stream 101 decreases by approximately 5° F. to 15° F. through compartment #10. In certain implementations, the temperatures of the cold streams 153 and 123 increase by approximately 30° F. to 40° F. through compartment #10. The thermal duties for P35 and P36 can be approximately 1-3 MMBtu/h (for instance, approximately 2 MMBtu/h) and 5-7 MMBtu/h (for instance, approximately 6 MMBtu/h), respectively.

In some examples, the systems described in this disclosure can be integrated into an existing gas processing plant as a retrofit or upon the phase out or expansion of propane or ethane refrigeration systems. A retrofit to an existing gas processing plant allows the power consumption of the liquid recovery system to be reduced with a relatively small amount of capital investment. Through the retrofit or expansion, the liquid recovery system can be made more compact. In some examples, the systems described in this disclosure can be part of a newly constructed gas processing plant.

While this specification contains many specific implementation details, these should not be construed as limitations on the scope of the subject matter or on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results.

Accordingly, the previously described example implementations do not define or constrain this disclosure. Other changes, substitutions, and alterations are also possible without departing from the spirit and scope of this disclosure.

What is claimed is:

1. A natural gas liquid recovery system comprising:

a first chill down separator;

a second chill down separator;

a third chill down separator;

one or more feed gas dehydrators positioned downstream of the first chill down separator;

a de-methanizer column;

a cold box comprising a plurality of compartments that segment a plate-fin heat exchanger into a plurality of sections, each compartment of the cold box configured to transfer heat from one or more of a plurality of hot process streams in the natural gas liquid recovery system to one or more of a plurality of cold process streams in the natural gas liquid recovery system, the plurality of hot process streams comprising:

a feed gas comprising a first mixture of hydrocarbons;

a dehydrated first chill down vapor from the one or more feed gas dehydrators; and a second chill down vapor from the second chill down separator, and the plurality of cold process streams comprising:

a high pressure residue gas from the third chill down separator;

an overhead low pressure residue gas from the de-methanizer column;

a de-methanizer reboiler feed from the de-methanizer column; and a de-methanizer bottoms from the de-methanizer column; and a refrigeration system configured to receive heat through the cold box, the refrigeration system comprising a primary refrigerant loop in fluid communication with the cold box, the primary refrigerant loop comprising a primary refrigerant comprising a second mixture of hydrocarbons, wherein:

each of the first chill down separator, the second chill down separator, and the third chill down separator are in fluid communication with the cold box, the first chill down separator configured to separate the feed gas into a liquid phase and a refined gas phase, the one or more feed gas dehydrators configured to remove water from the refined gas phase to produce the dehydrated first chill down vapor, and the cold box is configured to transfer heat from the dehydrated first chill down vapor to the high pressure residue gas through four of the compartments of the cold box, from the dehydrated first chill down vapor to the overhead low pressure residue gas through four of the compartments of the cold box, from the dehydrated first chill down vapor to the de-methanizer reboiler feed through one of the compartments of the cold box, and from the dehydrated first chill down vapor to the de-methanizer bottoms through one of the compartments of the cold box.

2. The natural gas liquid recovery system of claim 1, further comprising the de-methanizer column in fluid communication with the cold box and configured to receive at least one hydrocarbon stream and separate the at least one hydrocarbon stream into a vapor stream comprising a sales gas comprising predominantly of methane and a liquid stream comprising a natural gas liquid comprising predominantly of hydrocarbons heavier than methane.

3. The natural gas liquid recovery system of claim 1, wherein the sales gas comprising predominantly of methane comprises at least 89 mol % of methane, and the natural gas liquid comprising predominantly of hydrocarbons heavier than methane comprises at least 99.5 mol % of hydrocarbons heavier than methane.

4. The natural gas liquid recovery system of claim 1, wherein the one or more feed gas dehydrators comprise a molecular sieve.

5. The natural gas liquid recovery system of claim 1, further comprising a liquid dehydrator configured to remove water from the liquid phase.

6. The natural gas liquid recovery system of claim 5, wherein the liquid dehydrator comprises a bed of activated alumina.

7. The natural gas liquid recovery system of claim 2, further comprising:

a feed pump configured to send a hydrocarbon liquid to the de-methanizer column;

a natural gas liquid pump configured to send natural gas liquid from the de-methanizer column; and a storage system configured to hold a portion of natural gas liquid from the de-methanizer column.

8. The natural gas liquid recovery system of claim 1, wherein the second mixture comprises on a mole fraction basis of 63% to 77% of $C_2$ hydrocarbon, 12% to 18% of $C_3$ hydrocarbon, 3% to 11% of $C_4$ hydrocarbon, and 3% to 14% of $C_5$ hydrocarbon.

9. The natural gas liquid recovery system of claim 1, wherein the refrigeration system comprises a refrigerant separator configured to separate the primary refrigerant into a primary refrigerant liquid and a primary refrigerant vapor, the primary refrigerant liquid and the primary refrigerant vapor being provided to the cold box.

10. The natural gas liquid recovery system of claim 1, wherein the refrigeration system comprises a compressor configured to receive and increase pressure of fluids from the cold box.

11. A method for recovering natural gas liquid from a feed gas, the method comprising:

transferring heat from a plurality of hot process streams to a plurality of cold process streams through a cold box, the cold box comprising a plurality of compartments that segment a plate-fin heat exchanger into a plurality of sections, wherein transferring heat from the plurality of hot process streams to the plurality of cold process streams through the cold box comprises transferring heat from one or more of the plurality of hot process streams to one or more of the plurality of cold process streams through each compartment of the cold box, the plurality of hot process streams comprising:

a feed gas comprising a first mixture of hydrocarbons;

a dehydrated first chill down vapor from one or more feed gas dehydrators of a natural gas liquid recovery system; and a second chill down vapor from a second chill down separator of the natural gas liquid recovery system, and the plurality of cold process streams comprising:

a high pressure residue gas from a third chill down separator of the natural gas liquid recovery system;

an overhead low pressure residue gas from a de-methanizer column of the natural gas liquid recovery system;

a de-methanizer reboiler feed from the de-methanizer column; and a de-methanizer bottoms from the de-methanizer column;

transferring heat to a refrigeration system through the cold box, the refrigeration system comprising a primary refrigerant loop in fluid communication with the cold box, the primary refrigerant loop comprising a primary refrigerant comprising a second mixture of hydrocarbons;

separating the feed gas into a liquid phase and a refined gas phase using the first chill down separator; and removing water from the refined gas phase using the one or more feed gas dehydrators to produce the dehydrated first chill down vapor, wherein transferring heat from the plurality of hot process streams to the plurality of cold process streams through the cold box comprises:

transferring heat from the dehydrated first chill down vapor to the high pressure residue gas through four of the compartments of the cold box;

transferring heat from the dehydrated first chill down vapor to the overhead low pressure residue gas through four of the compartments of the cold box;

transferring heat from the dehydrated first chill down vapor to the de-methanizer reboiler feed through one of the compartments of the cold box; and transferring heat from the dehydrated first chill down vapor to the de-methanizer bottoms through one of the compartments of the cold box.

12. The method of claim 11, wherein the second mixture comprises on a mole fraction basis of 63% to 77% of $C_2$ hydrocarbon, 12% to 18% of $C_3$ hydrocarbon, 3% to 11% of $C_4$ hydrocarbon, and 3% to 14% of $C_5$ hydrocarbon.

13. The method of claim 11, further comprising condensing at least a portion of the feed gas in at least one compartment of the cold box.

14. The method of claim 11, further comprising:

receiving at least one hydrocarbon stream in the de-methanizer column in fluid communication with the cold box; and separating the at least one hydrocarbon stream into a vapor stream comprising a sales gas comprising predominantly of methane and a liquid stream comprising a natural gas liquid comprising predominantly of hydrocarbons heavier than methane.

15. The method of claim 14, wherein the sales gas comprising predominantly of methane comprises at least 89 mol % of methane, and the natural gas liquid comprising predominantly of hydrocarbons heavier than methane comprises at least 99.5 mol % of hydrocarbons heavier than methane.

16. The method of claim 13, wherein the one or more feed gas dehydrators comprise a molecular sieve.

17. The method of claim 13, further comprising removing water from the liquid phase using a liquid dehydrator comprising a bed of activated alumina.

18. The method of claim 11, further comprising:

sending a hydrocarbon liquid to the de-methanizer column using a feed pump;

sending natural gas liquid from the de-methanizer column using a natural gas liquid pump; and storing an amount of natural gas liquid from the de-methanizer column in a storage system.

19. A system comprising:

a first chill down separator;

a second chill down separator;

a third chill down separator;

one or more feed gas dehydrators positioned downstream of the first chill down separator;

a de-methanizer column;

a cold box comprising a plurality of compartments that segment a plate-fin heat exchanger into a plurality of sections, each compartment of the cold box configured to transfer heat from one or more of a plurality of hot process streams to one or more of a plurality of cold process streams;

the plurality of hot process streams, each of the plurality of hot process streams flowing through one or more of the plurality of compartments, the plurality of hot process streams comprising:

a feed gas comprising a mixture of hydrocarbons;

a dehydrated first chill down vapor from the one or more feed gas dehydrators; and a second chill down vapor from the second chill down separator;

the plurality of cold process streams, each of the plurality of cold process streams flowing through one or more of the plurality of compartments, the plurality of cold process streams comprising:

a high pressure residue gas from the third chill down separator;

an overhead low pressure residue gas from the de-methanizer;

a de-methanizer reboiler feed from the de-methanizer column; and a de-methanizer bottoms from the de-methanizer column; and one or more refrigerant streams, each of the one or more refrigerant streams flowing through one or more of the plurality of compartments, wherein the cold box is configured to transfer heat from the dehydrated first chill down vapor to the high pressure residue gas through four of the compartments of the cold box, from the dehydrated first chill down vapor to the overhead low pressure residue gas through four of the compartments of the cold box, from the dehydrated first chill down vapor to the de-methanizer reboiler feed through one of the compartments of the cold box, and from the dehydrated first chill down vapor to the de-methanizer bottoms through one of the compartments of the cold box.

20. The system of claim 19, wherein the de-methanizer reboiler feed is the only stream that flows through only one of the plurality of compartments.

21. The system of claim 20, wherein the overhead low pressure residue gas is the only stream that flows through all of the plurality of compartments.

22. The system of claim 19, wherein the one or more refrigerant streams comprise a first refrigerant stream and a second refrigerant stream, wherein the first and second refrigerant streams are different phases from a single mixed refrigerant stream, wherein each of the first and second refrigerant streams have compositions different from each other and from the single mixed refrigerant stream, wherein each of the first and second refrigerant streams flow through the same one or more of the plurality of compartments.

23. The system of claim 19, wherein a total number of compartments is 10.

* * * * *